US007510244B1

(12) United States Patent
Shin

(10) Patent No.: US 7,510,244 B1
(45) Date of Patent: Mar. 31, 2009

(54) EVENT CHAIR CONSTRUCTION

(76) Inventor: Justin H. Shin, 104 11th St., Cresskill, NJ (US) 07626

( * ) Notice: Subject to any disclaimer, the term of this patent is extended or adjusted under 35 U.S.C. 154(b) by 389 days.

(21) Appl. No.: 11/291,792

(22) Filed: Dec. 1, 2005

(51) Int. Cl.
*A47C 3/04* (2006.01)
*A47C 5/12* (2006.01)
*A47C 1/12* (2006.01)

(52) U.S. Cl. ..... 297/451.11; 297/239; 297/DIG. 2; 297/446.2

(58) Field of Classification Search ..... 297/451.1, 297/449.1, 451.13, 440.1, 440.15, 446.2, 297/440.22, 445.1, 451.11, 446.1, 239, DIG. 2; 29/428; 264/239
See application file for complete search history.

(56) References Cited

U.S. PATENT DOCUMENTS

| | | | | |
|---|---|---|---|---|
| 882,316 | A | 3/1908 | Horton | |
| 3,527,498 | A | 9/1970 | Werner | |
| 3,583,733 | A | 6/1971 | Anderson | |
| 3,639,001 | A * | 2/1972 | Anderson | 297/451.1 |
| 3,658,382 | A | 4/1972 | Anderson | |
| 3,698,150 | A | 10/1972 | Anderson | |
| 3,709,560 | A | 1/1973 | Binek | |
| 3,873,154 | A | 3/1975 | Baker, Jr. | |
| 4,146,269 | A | 3/1979 | Beckley | |
| 4,588,227 | A | 5/1986 | Austin | |
| 4,799,735 | A | 1/1989 | Meyer | |
| 4,850,647 | A | 7/1989 | Engel | |
| 4,880,276 | A | 11/1989 | Shovar | |
| 4,966,415 | A | 10/1990 | Schwartz et al. | |
| 5,067,842 | A | 11/1991 | Ponting | |
| 5,088,792 | A | 2/1992 | Guichon | |
| 5,611,602 | A | 3/1997 | Brady | |
| 5,655,815 | A | 8/1997 | Lohmeyer | |
| 5,762,396 | A | 6/1998 | Barile | |
| 5,988,755 | A | 11/1999 | Fastelli et al. | |
| 6,666,518 | B2 | 12/2003 | Bruschi et al. | |
| 2001/0052723 | A1 * | 12/2001 | Wu | 297/440.1 |

FOREIGN PATENT DOCUMENTS

| | | |
|---|---|---|
| GB | 898479 | 6/1962 |
| GB | 1 278 727 | 6/1972 |
| WO | WO 01/19219 | 3/2001 |

* cited by examiner

*Primary Examiner*—Milton Nelson, Jr.
(74) *Attorney, Agent, or Firm*—Arthur Jacob

(57) ABSTRACT

A chair construction includes a back member having back legs, a front member having front legs, and side members, all constructed of a synthetic polymeric material molded about a reinforcing metal core, the metal cores being constructed for securement together to establish an integral reinforcing metal core structure enveloped within unitary sheaths of synthetic polymeric material corresponding to each of the back member, the front member and the side members, subsequent to constructing each of the back member, the front member and the side members, so as to erect a chair having the durability, aesthetic appearance and feel provided by the synthetic polymeric material, and the strength and rigidity provided by the integral reinforcing metal core structure. The chair has a seat member and a stacking construction for stacking like chairs in a stable vertical stack of upper and lower chairs, the stacking construction including a front brace and camming surfaces dimensioned, configured and located relative to the front brace such that upon stacking an upper chair upon a lower chair, legs of the upper chair are engaged by the camming surfaces of the lower chair and the front brace of the upper chair is moved into engagement with the seat member of the lower chair, beneath the seat member, to stabilize the stacked upper and lower chairs.

33 Claims, 8 Drawing Sheets

EVENT CHAIR CONSTRUCTION

The present invention relates generally to chairs and pertains, more specifically, to event chairs and a method of constructing event chairs primarily of synthetic polymeric materials and with structural features enabling increased durability, greater strength and rigidity, exemplary comfort and safety, and with the ability to be stacked in uniform, stable stacks for storage and transport.

Event chairs have found widespread use in supplying seating for varying numbers of attendees at functions held at many different sites. When not in use, these chairs are stacked for convenient storage, and for ready transport to and from the site of an event. The more desirable of these event chairs have essentially the same appearance so that when multiple like chairs are set up at a particular function, these multiple chairs present an aesthetically pleasing uniform seating arrangement.

A currently popular style of event chair is a chair commonly known as a "Chiavari style" ballroom chair, constructed mainly of wood or metal, with a uniform finish. These wooden and metal ballroom chairs provide a combination of comfortable seating and aesthetic appearance found to be most desirable among audiences attending a wide variety of functions. However, wooden chairs lack long-term durability and require frequent attention in order to maintain both comfort and appearance, as well as safety through structural integrity. Metal chairs, while possessed of sufficient strength and rigidity, are relatively heavy and have a less desirable "feel", that is, these chairs generally are cold and unappealing to the touch. Moreover, these wooden chairs and metal chairs are difficult to stack in efficient, stable stacks.

More recently, ballroom chairs have been constructed of synthetic polymeric materials in an effort to overcome the shortcomings of wooden and metal ballroom chairs. Generally, these plastic chairs have proven to be more durable than wooden chairs and have a better "feel" than metal chairs. In addition, the added flexibility in construction has enabled the incorporation of structural features which allow somewhat more convenient and effective stacking. However, the cost of materials, as well as strength, rigidity, weight and safety considerations, has hampered the ability to simulate, in chairs constructed of suitable synthetic polymeric materials, the desired aesthetic appearance, strength, rigidity, comfort and safety provided by the now-traditional wooden and metal event chairs.

The present invention overcomes the above-outlined shortcomings of wooden and metal event chairs, as well as previously available synthetic polymeric chairs, in a chair construction which incorporates synthetic polymeric materials for durability, surface finish, aesthetic appearance and feel, as well as longevity with minimal maintenance requirements, and metal components for requisite strength, rigidity, and added safety and durability. As such, the present invention attains several objects and advantages, some of which are summarized as follows: Provides an event chair and method of constructing an event chair enabling ready manufacture utilizing a combination of synthetic polymeric materials and reinforcing metal components to simulate closely the aesthetic appearance and seating comfort of previous event chairs constructed of wood or metal, while attaining requisite strength, rigidity and durability; provides event chairs and a method of construction which incorporate synthetic polymeric materials to enable conservation of synthetic polymeric material, with a concomitant reduction in cost, while attaining enhanced strength, rigidity, comfort and safety, as well as a desired aesthetic appearance and feel; enables effective and efficient stacking of event chairs in stable and uniform stacks for convenient storage, and for ready transport to and from the site of an event; provides event chairs of increased structural strength and rigidity as well as durability, while more closely simulating the aesthetic appearance of traditional wooden and metal event chairs; facilitates the manufacture and compact packaging for storage and for shipping of event chairs to end users, with increased ease of erection by such end users; enables economical manufacture of event chairs requiring less maintenance and providing exemplary performance over an increased service life.

The above objects and advantages are attained by the present invention which may be described briefly as a chair having component parts capable of compact packaging for transportation and storage, and ready assembly to erect the chair for use, the chair comprising: a seat member extending longitudinally between a front edge and a longitudinally opposite back edge, and having laterally opposite side edges; a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides; a front member having a front seat support extending laterally between opposite front seat support ends, a pair of front legs depending from the front seat support, with one front leg extending altitudinally downwardly from adjacent each front seat support end to a corresponding front foot end; at least one side member for extending longitudinally between each front leg and a corresponding rear leg, and for being coupled with the corresponding front and rear legs; the back member being constructed of a synthetic polymeric material reinforced with a metal core such that the rear seat support, the rear legs and the chair back comprise an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back; the front member being constructed of a synthetic polymeric material reinforced with a metal core such that the front legs each comprise an integral structure of synthetic polymeric material having an integral reinforcing metal core extending altitudinally through each front leg from adjacent a corresponding front foot end of each front leg to adjacent a corresponding front seat support end; each side member being constructed of a synthetic polymeric material reinforced with a metal core such that each side member comprises an integral structure of synthetic polymeric material having an integral reinforcing metal core extending longitudinally through each side member; and a coupling arrangement at each end of each side member, at the front member, and at the back member for coupling the metal core of each side member with the metal core of the front member and the metal core of the back member, such that upon erection of the chair each side member will extend longitudinally between corresponding front and rear legs and engage a front leg intermediate the front seat support and a corresponding front foot end, and engage a rear leg intermediate the rear seat support and a corresponding rear foot end, with the metal cores of the front member, the back member and the side members secured together in an integral metal core structure.

In addition, the present invention includes an improvement in a chair having component parts capable of ready assembly to erect the chair for use, the chair including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the improvement comprising: the front seat support of the front member including a lateral support element extending between the front seat support ends and a transverse support element integral with the lateral support element adjacent each front seat support end, the transverse support elements being oriented in a generally longitudinal direction and having a longitudinal length for engaging corresponding portions of the seat member adjacent the front edge of the seat member to facilitate stabilizing of the seat member upon erection of the chair.

Further, the present invention provides an improvement in a chair having component parts capable of ready assembly to erect the chair for use, the chair including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the improvement comprising: the rear seat support including a beam member extending between the rear seat support ends, the beam member establishing a beam configuration for engagement with the seat member adjacent the back edge of the seat member to facilitate support of the seat member upon erection of the chair.

Still further, the present invention includes a chair constructed for stacking readily with like chairs in a stable vertical stack of contiguous upper and lower chairs, each chair of the stack including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the chair including a stacking construction comprising: a front brace extending laterally between the front legs, intermediate each front seat support end and a corresponding front foot end; and a camming surface along each side edge of the seat member, adjacent an intersection of a corresponding side edge with the back edge of the seat member; the camming surfaces being configured, dimensioned and located relative to the rear legs and the front brace such that upon juxtaposition of an upper chair over a lower chair to establish the vertical stack of chairs, the camming surfaces of the lower chair will engage the rear legs of the upper chair to move the upper chair in a rearward direction relative to the lower chair as the upper chair is lowered over the lower chair, and simultaneously to move the front brace of the upper chair rearwardly to be placed beneath and into engagement with the seat member of the lower chair, adjacent the front edge of the seat member of the lower chair, thereby stabilizing the stacked upper and lower chairs by virtue of the engagement between the camming surfaces of the lower chair and corresponding rear legs of the upper chair, and the engagement between the front brace of the upper chair and the seat member of the lower chair, adjacent the front edge of the seat member of the lower chair.

Additionally, the present invention includes a chair constructed of a synthetic polymeric material reinforced with an integral reinforcing metal core structure, the chair comprising: a seat member extending longitudinally between a front edge and a longitudinally opposite back edge, and having laterally opposite side edges; a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides; a front member having a front seat support extending laterally between opposite front seat support ends, a pair of front legs depending from the front seat support, with one front leg extending altitudinally downwardly from adjacent each front seat support end to a corresponding front foot end; at least one side member extending longitudinally between each front leg and a corresponding rear leg, and being coupled with the corresponding front and rear legs; the back member being constructed of a synthetic polymeric material reinforced with a metal core such that the rear seat support, the rear legs and the chair back comprise an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back; the front member being constructed of a synthetic polymeric material reinforced with a metal core such that the front legs each comprise an integral structure of synthetic polymeric material having an integral reinforcing metal core extending altitudinally through each front leg from adjacent a corresponding front foot end of each front leg to adjacent a corresponding front seat support end; each side member being constructed of a synthetic polymeric material reinforce with a metal core such that each side member comprises an integral structure of synthetic polymeric material having an integral reinforcing metal core extending longitudinally through each side member; and corresponding ends of each side member being joined respectively with the front member and with the back member, with the metal core of each side member joined with the metal core of the front member and with the metal core of the back member, such that each side member extends longitudinally between corresponding front and rear legs and engages a front leg intermediate the front seat support and a corresponding front foot end, and engages a rear leg intermediate the rear seat support and a corresponding rear foot end and the metal cores of the front member, the back member and the side members are joined in an integral reinforcing metal core structure.

Further, the present invention provides a method for constructing a chair having component parts capable of compact packaging for transportation and storage, and ready assembly to erect the chair for use, the method comprising: constructing a seat member extending longitudinally between a front edge and a longitudinally opposite back edge, and having laterally opposite side edges; constructing a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides; constructing a front member having a front seat support extending laterally between opposite front seat support ends, a pair of front legs depending from the front seat support, with one front leg extending altitudinally downwardly from adjacent each front seat support end to a corresponding front foot end; constructing at least one side member for extending longitudinally between each front leg and a corresponding rear leg, and for being coupled with the corresponding front and rear legs; constructing the back member of a synthetic polymeric material reinforced with a metal core such that the rear seat support, the rear legs and the chair back comprise an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back; constructing the front member of a synthetic polymeric material reinforced with a metal core such that the front legs each comprise an integral structure of synthetic polymeric material having an integral reinforcing metal core extending altitudinally through each front leg from adjacent a corresponding front foot end of each front leg to adjacent a corresponding front seat support end; constructing each side member of a synthetic polymeric material such that each side member comprises an integral structure of synthetic polymeric material having an integral reinforcing metal core extending longitudinally through each side member; and coupling the metal core of each side member with the metal core of the front member and the metal core of the back member, such that each side member extends longitudinally between corresponding front and rear legs and engages a front leg intermediate the front seat support and a corresponding front foot end, and engages a rear leg intermediate the rear seat support and a corresponding rear foot end, with the metal cores of the front member, the back member and the side members secured together in an integral metal core structure.

The present invention will be understood more fully, while still further objects and advantages will become apparent, in the following detailed description of preferred embodiments of the invention illustrated in the accompanying drawing, in which.

Figure 1:
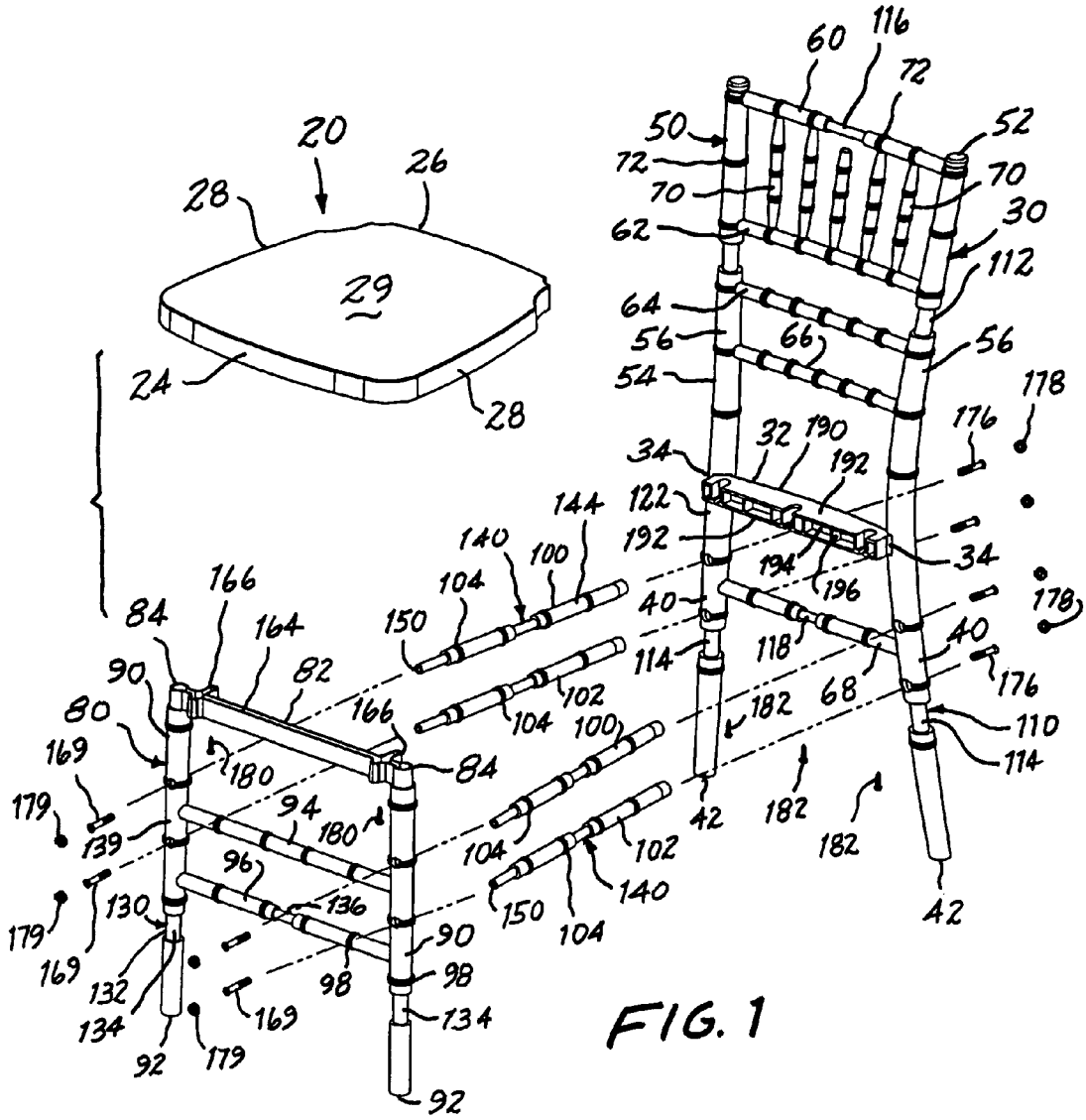
FIG. 1 is an exploded perspective view showing component parts of an event chair constructed in accordance with the present invention, with portions removed to show internal structure.
Figure 2:
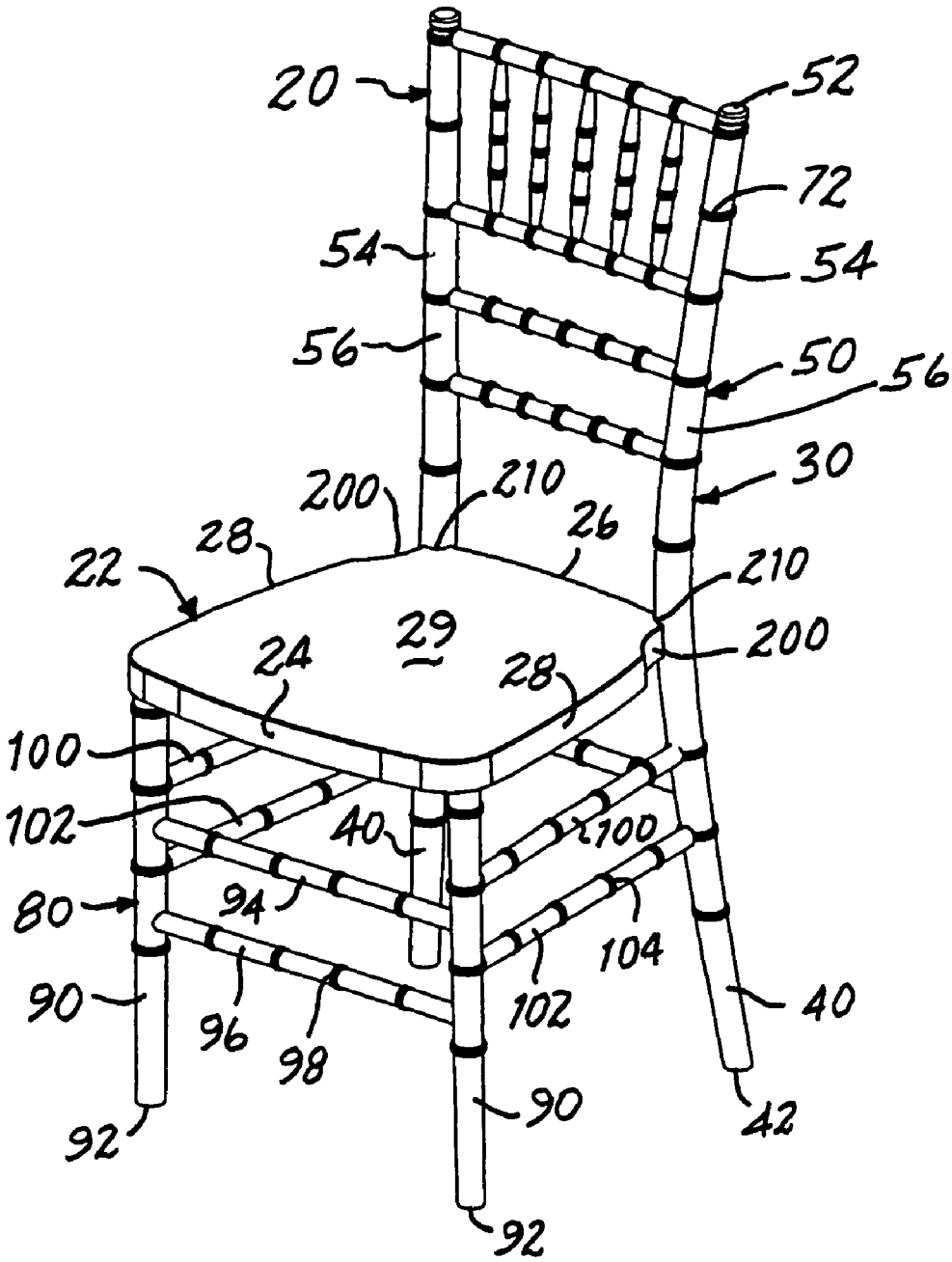
FIG. 2 is a pictorial perspective view of the component parts of FIG. 1, erected into the event chair in accordance with the present invention.

Referring now to the drawing, and especially to FIGS. 1 and 2 thereof, an event chair constructed in accordance with the present invention is shown in the form of a "Chiavari style" chair 20, illustrated in FIG. 1 as unassembled component parts about to be assembled, and shown in FIG. 2 in an assembled, erected configuration. Chair 20 is seen to have a seat member 22 extending longitudinally, in generally horizontal directions, between a front edge 24 and a longitudinally opposite back edge 26, and having laterally opposite side edges 28, all for establishing a seat 29. Seat member 22 is molded in one piece, of a synthetic polymeric material, a preferred material being polypropylene, and ordinarily receives a seat cushion (not shown) placed upon seat 29.

A back member is shown in the form of a back frame 30 having a rear seat support 32 extending laterally, in generally horizontal directions, between opposite rear seat support ends 34. A pair of rear legs 40 depend from rear seat support 32, with one rear leg 40 extending altitudinally, in a generally vertical direction, downwardly, and somewhat rearwardly, from adjacent each rear seat support end 34 to a corresponding rear foot end 42. A chair back 50 extends altitudinally in a generally vertical direction upwardly from rear seat support 32 to a head end 52, the chair back 50 extending laterally between opposite sides 54. In the style of illustrated event chair 20, chair back 50 is provided with side posts 56 extending altitudinally upwardly, and somewhat rearwardly, along sides 54 from respective rear seat support ends 34 to head end 52, an uppermost head brace 60 extending laterally between the side posts 56 and interconnecting the side posts 56 adjacent head end 52, and intermediate braces 62, 64 and 66 extending laterally between the side posts 56 and interconnecting the side posts 56 intermediate head brace 60 and the rear seat support 32. A lower back brace 68 extends laterally between rear legs 40 and interconnects rear legs 40 intermediate rear seat support 32 and respective rear foot ends 42. A plurality of vertically oriented laterally spaced apart spindles 70 extend between head brace 60 and intermediate brace 62, in the traditional design of the "Chiavari style". Further in that traditional design, the rear legs 40, side posts 56, braces 60, 62, 64, 66 and 68, and spindles 70 all are provided with decorative rings 72 placed in pairs spaced apart along each leg, post, brace and spindle.

A front member is shown in the form of front frame 80 having a front seat support 82 extending laterally, in generally horizontal directions, between opposite front seat support ends 84. A pair of front legs 90 depend from front seat support 82, with one front leg 90 extending altitudinally, in a generally vertical direction, downwardly from adjacent each front seat support end 84 to a corresponding front foot end 92. The front legs 90 are interconnected by an upper front brace 94 and a lower front brace 96, each of which front braces 94 and 96 extend laterally between the front legs 90, intermediate the front seat support 82 and the front foot ends 92. Again, in accordance with the design style of chair 20, the front legs 90 and braces 94 and 96 are provided with decorative rings 98 placed in pairs spaced apart along each leg and brace.

At each side of chair 20, an upper side member 100 and a lower side member 102 extend longitudinally, in horizontal directions, between corresponding front and rear legs 90 and 40, interconnecting the front and rear legs 90 and 40 at altitudinal locations vertically intermediate respective front and rear seat supports 82 and 32 and corresponding front and rear foot ends 92 and 42. Here too, in accordance with the traditional design of chair 20, decorative rings 104 are placed in pairs spaced apart along each side member 100 and 102.

Figure 3:
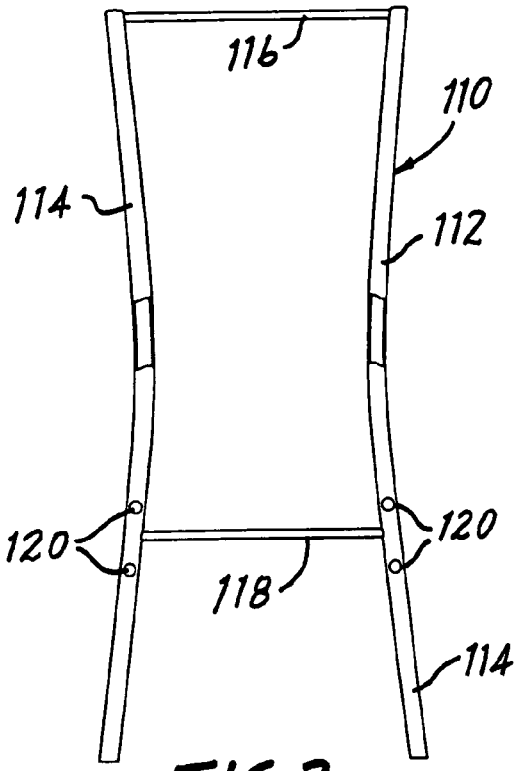
FIG. 3 is a front elevational view of a rear reinforcing frame for incorporation into the chair in accordance with the construction of the present invention.

Back frame 30 is constructed of a synthetic polymeric material, preferably polypropylene, such that the rear seat support 32, the rear legs 40 and the chair back 50, including posts 56 and all of the braces 60 through 68, as well as spindles 70, are formed in an integral structure, preferably molded in one piece so as to be unitary. In order to lend strength and rigidity, back frame 30 is provided with a metal core 110, preferably in the form of tubular steel components extending through some of the elements of back frame 30, as will now be described. As seen in FIG. 3, as well as in FIGS. 1 and 2, metal core 110 is constructed in the form of an integral reinforcing frame 112 of tubular metal, preferably tubular steel, having side frame components 114 corresponding to rear legs 40 and side posts 56 of chair back 50, upper lateral frame component 116 corresponding to head brace 60 of chair back 50, and lower lateral frame component 118 corresponding to lower back brace 68. Frame components 114, 116 and 118 are joined together, as by welding, to establish integral reinforcing frame 112. Side frame components 114 are provided with through holes 120 aligned in longitudinal directions for purposes to be described below. The synthetic polymeric material is formed about the reinforcing frame 112, to establish a unitary sheath 122 of synthetic polymeric material essentially enveloping the reinforcing frame 112, preferably by molding, with access provided to through holes 120, to complete back frame 30. At the same time, rear seat support 32, braces 62, 64 and 66, and spindles 70 are molded unitary with sheath 122.

Figure 4:
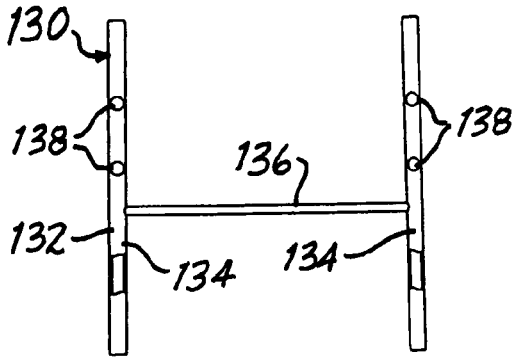
FIG. 4 is a rear elevational view of a front reinforcing frame for incorporation into the chair in accordance with the construction of the present invention.

In a similar manner, front frame 80 is constructed of a synthetic polymeric material, preferably polypropylene, such that the front seat support 82, front legs 90 and the front braces 94 and 96 are formed in an integral structure, preferably molded in one piece so as to be unitary. In order to lend strength and rigidity, front frame 80 is provided with a metal core 130, preferably in the form of tubular steel components extending through at least some of the elements of front frame 80, as will now be described. As seen in FIG. 4, as well as in FIGS. 1 and 2, metal core 130 is constructed in the form of an integral reinforcing frame 132 of tubular metal, preferably tubular steel, having side frame components 134 corresponding to front legs 90. In the illustrated preferred embodiment, reinforcing frame 132 includes a lateral frame component 136 corresponding to lower front brace 96. Frame components 134 and 136 are joined together, as by welding, to establish integral reinforcing frame 132. Side frame components 134 are provided with through holes 138 aligned in longitudinal directions for purposes to be described below. The synthetic polymeric material is formed about the reinforcing frame 132, to establish a unitary sheath 139 of synthetic polymeric material essentially enveloping the reinforcing frame 132, preferably by molding, with access provided to through holes 138, to complete front frame 80. At the same time, front seat support 82 and upper front brace 94 are molded unitary with sheath 139.

Figure 5:
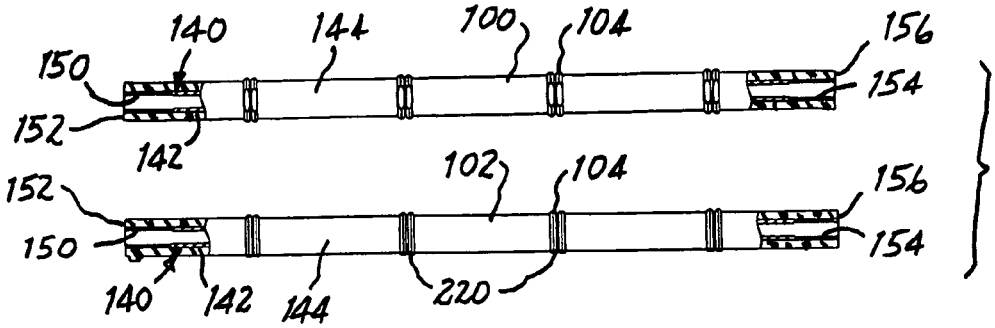
FIG. 5 is a side elevational view of side members of the chair.

Turning now to FIG. 5, as well as to FIG. 1, upper side member 100 and lower side member 102 each are constructed of a synthetic polymeric material, preferably polypropylene. In order to lend strength and rigidity, each side member 100 and 102 is provided with a metal core 140, preferably in the form of a tubular steel reinforcing rod 142 extending longitudinally through each side member 100 and 102. The synthetic polymeric material is formed about each reinforcing rod 142, preferably by molding to establish a unitary sheath 144 essentially enveloping each reinforcing rod 142. A fastener element in the form of an internal screw-threaded recess 150 is located at a forward end 152 of each reinforcing rod 142 and extends longitudinally into reinforcing rod 142. Likewise, each reinforcing rod 142 is provided with a fastener element in the form of an internal screw-threaded recess 154 at a rearward end 156 of each rod 142. Access is provided to screw-threaded recesses 150 and 154, to complete each side member 100 and 102.

Figure 6:
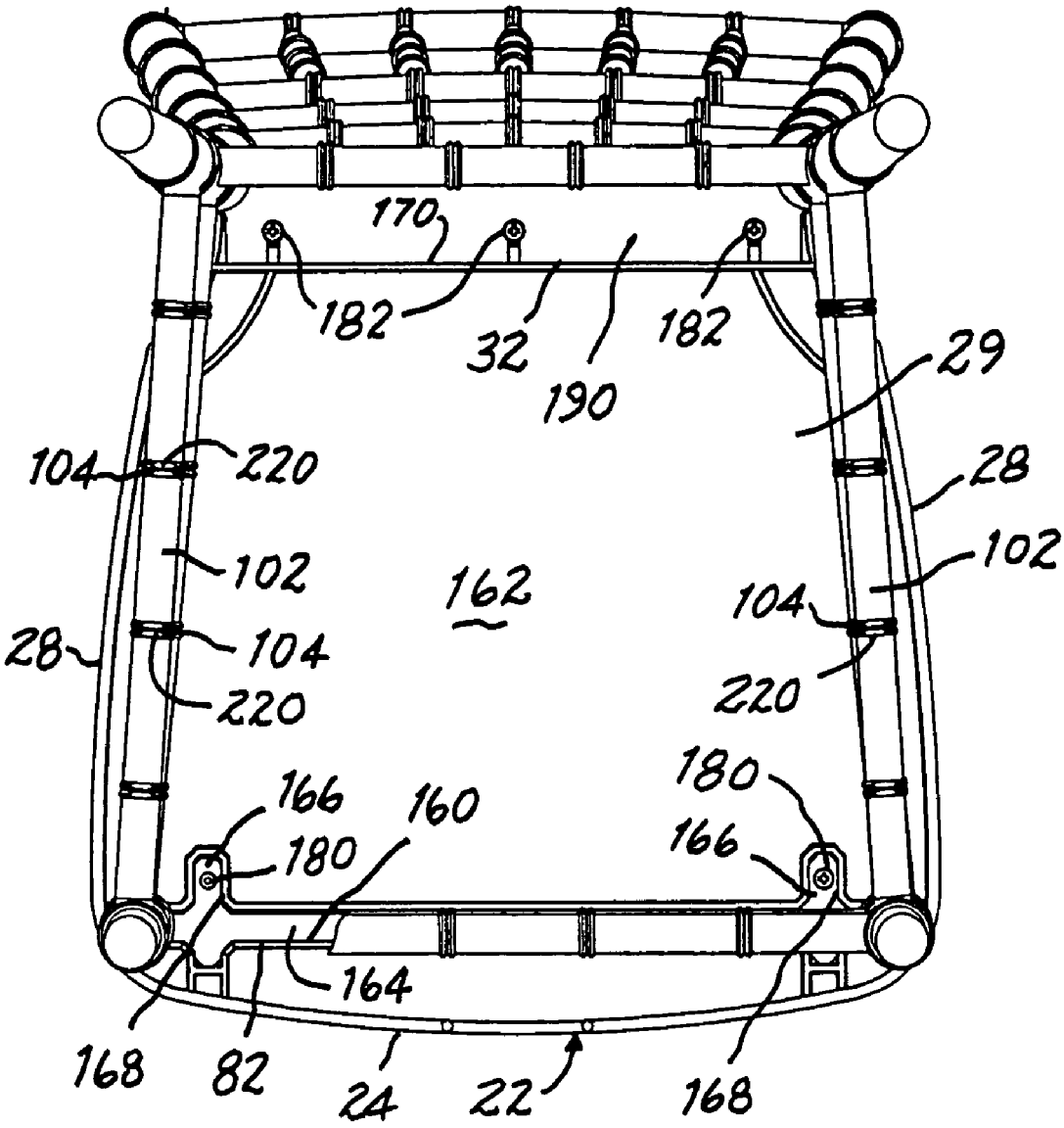
FIG. 6 is a bottom plan view of the erect chair of FIG. 2.

The unassembled component parts of chair 20, namely, seat member 22, back frame 30, front frame 80 and side members 100 and 102, are packaged readily in a compact package for facilitating shipping and storage prior to erection for use. Once shipped to an end user, such as a supplier of event chairs or a catering facility or the like, the component parts are assembled readily by the end user to erect a complete event chair 20. With reference to FIGS. 1 and 6, front frame 80 is assembled with seat member 22 by first inserting front seat support 82 into a complementary front seat recess 160 which extends laterally across the underside 162 of seat member 22 adjacent and essentially parallel to front edge 24. To this end, front seat support 82 includes a support element in the form of a laterally extending rib 164 formed integral with the front seat support 82 and extending between the front seat support ends 84, the rib 164 being complementary to front seat recess 160 for a relatively snug fit.

Stability of the seat member 22 relative to the front frame 80 is enhanced by providing a transverse support element integral with the lateral support element adjacent each front seat support end 84, the transverse support elements being shown in the form of support bars 166 integral with rib 164 adjacent each seat support end 84 and oriented in a generally longitudinal direction for reception within corresponding portions of the front seat recess 160, shown in the form of sockets 168 complementary to corresponding support bars 166 for a relatively snug fit between the respective bars 166 and sockets 168. The snug fit, combined with the longitudinal length of each support bar 166 and the generally cruciform configuration of the engagement between the front seat support 82 and the seat member 22 adjacent the front seat support ends 84, provides a high degree of stability in the erected chair 22.

Once the front frame 80 is placed in seat member 22, as set forth above, the upper and lower side members 100 and 102 are assembled with the front frame 80 by a coupling arrangement provided by the through holes 138 in the side frame components 134 of reinforcing frame 132 within front frame 80, screw-threaded recesses 150 extending into the reinforcing rod 142 of each side member 100 and 102, and bolts 169 complementary to recesses 150. Each bolt 169 is passed through a corresponding through hole 138 and is secured within a corresponding complementary screw-threaded recess 150 to securely couple reinforcing rods 142 with reinforcing frame 132, and, consequently, side members 100 and 102 with front frame 80.

Once all four side members 100 and 102 are secured in place, back frame 30 is juxtaposed with the back edge 26 of seat member 22, placing the rear seat support 32 under seat 29 of the seat member 22, with the rear seat support 32 abutting a rear rib 170 which depends from seat 29 and extends laterally across seat member 22, between side edges 28, adjacent back edge 26. At the same time, through holes 120 in side frame components 114 of reinforcing frame 112 within back frame 30 are aligned with counterpart screw-threaded recesses 154 provided in reinforcing rods 142 of side members 100 and 102. The coupling arrangement which couples the side members 100 and 102 to the back frame 30 includes screw-threaded bolts 176 which are passed through the through holes 120 and into corresponding screw-threaded recesses 154 to securely couple reinforcing rods 142 with reinforcing frame 112, and, consequently, side members 100 and 102 with back frame 30. Plugs 178 and 179 of synthetic polymeric material matching that of sheaths 122 and 139, respectively, then are placed over respective bolts 176 and 169 to cover the bolts 176 and 169 and maintain the aesthetic appearance of the assembled chair 20.

Assembly of chair 20 is completed by bolting the seat member 22 to the front seat support 82 by means of bolts 180, and by bolting the seat member 22 to the rear seat support 32 by means of bolts 182. Support of the seat member 22 along the rear seat support 32 is enhanced by the structural configuration of the rear seat support 32. Thus, the rear seat support 32 preferably is constructed in the form of a beam member 190 extending between the rear seat support ends 34, the beam member 190 including laterally extending, altitudinally spaced apart flanges 192 interconnected with a laterally extending web 194 and altitudinally extending, laterally spaced apart ribs 196 for providing the rear seat support 32 with a somewhat hollow beam configuration having a high degree of strength and rigidity, with a minimum of material, and reduced weight.

Upon completion of the assembly of chair 20, the reinforcing frames 112 and 132, and the reinforcing rods 142 are joined together and secured in an integral reinforcing metal core structure which imparts a high degree of strength and rigidity to chair 20, while the sheaths 112, 122 and 144 of synthetic polymeric material provide the advantages of durability, reduced maintenance, and an aesthetically pleasing appearance and feel, all as set forth above.

Figure 7:
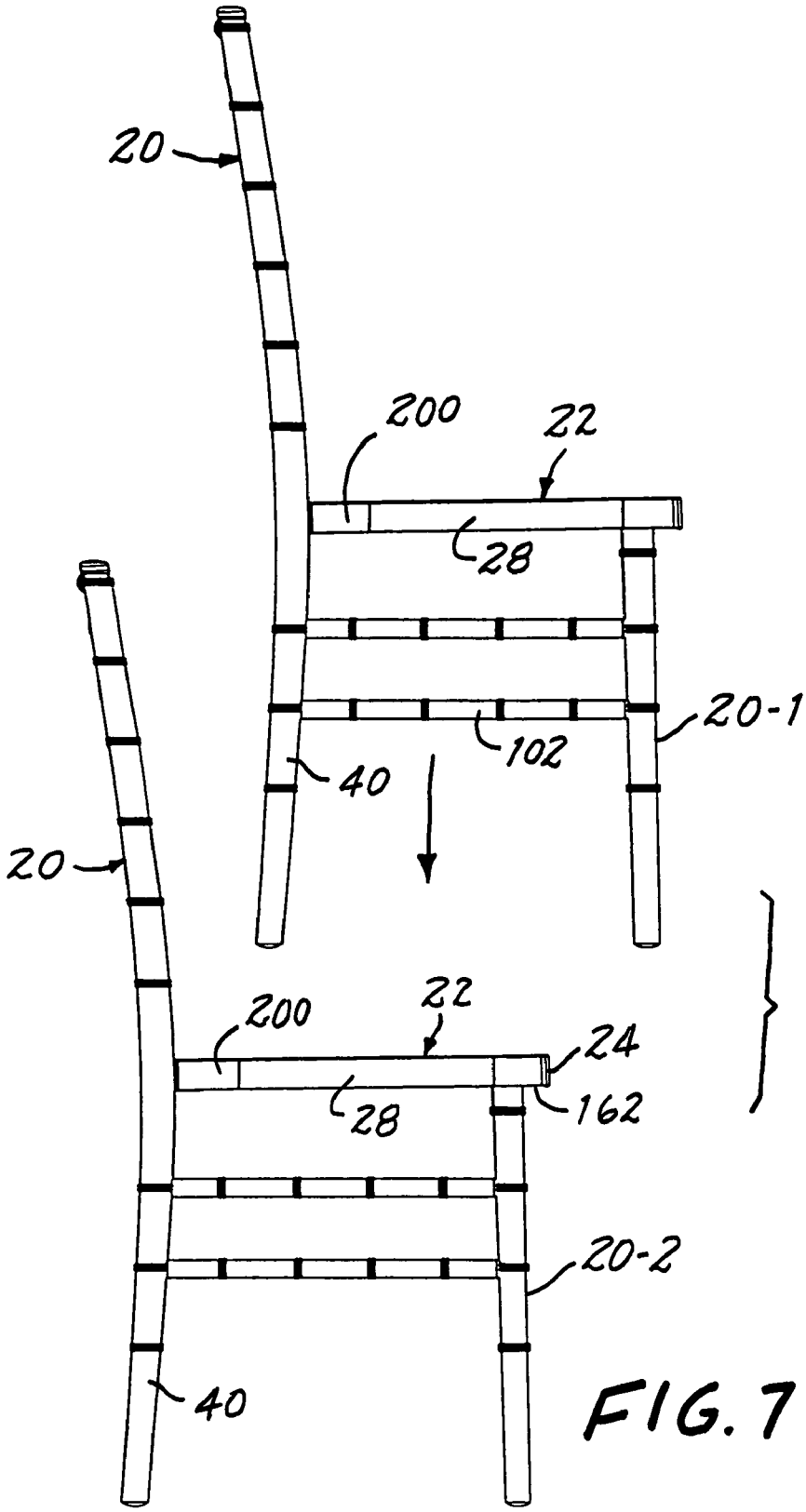
FIG. 7 is a side elevational view showing erected event chairs in a stage of being brought into a stable stack.
Figure 8:
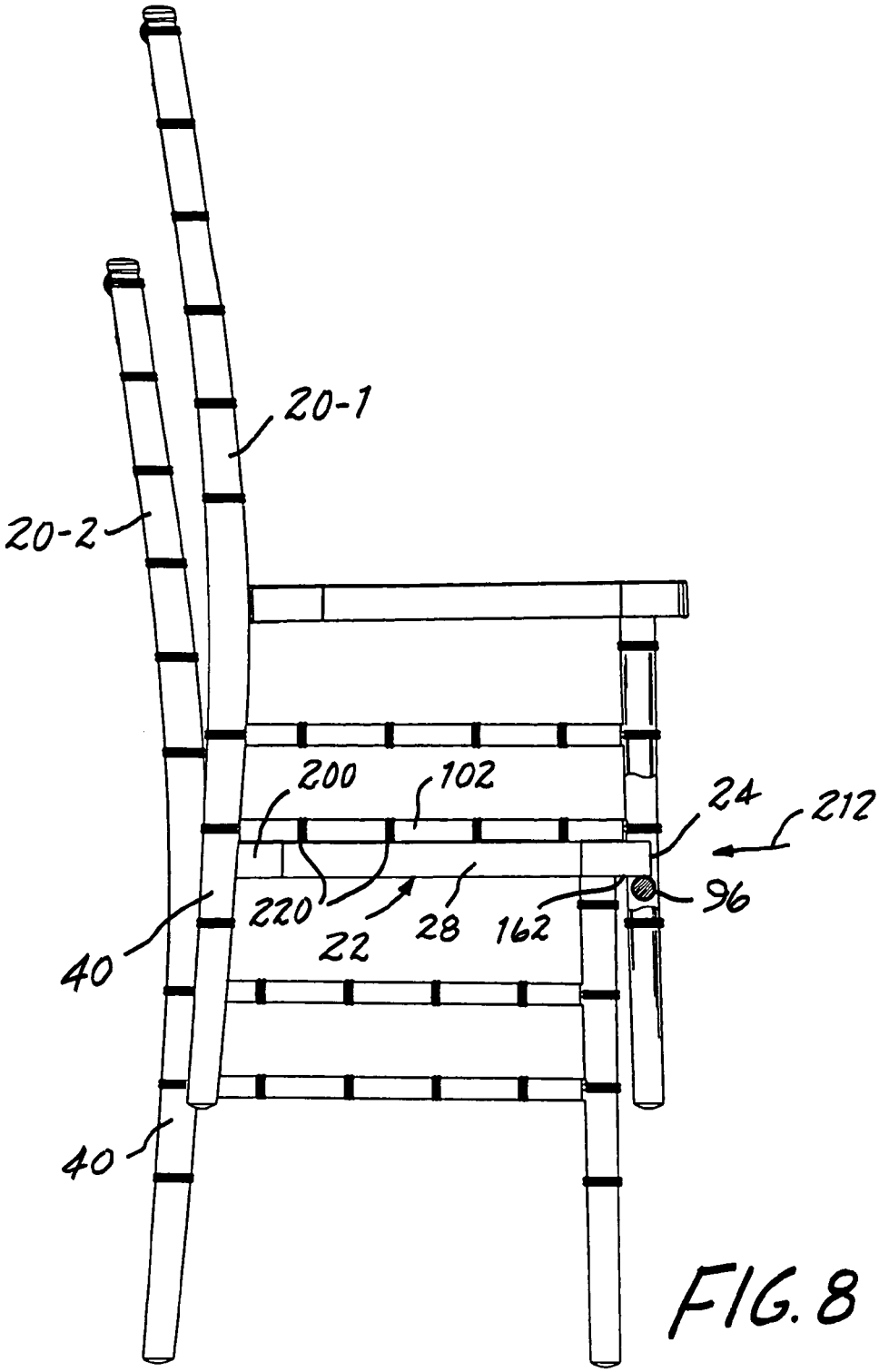
FIG. 8 is a side elevational view similar to FIG. 7 and showing the event chairs stacked in a stable stack.
Figure 9:
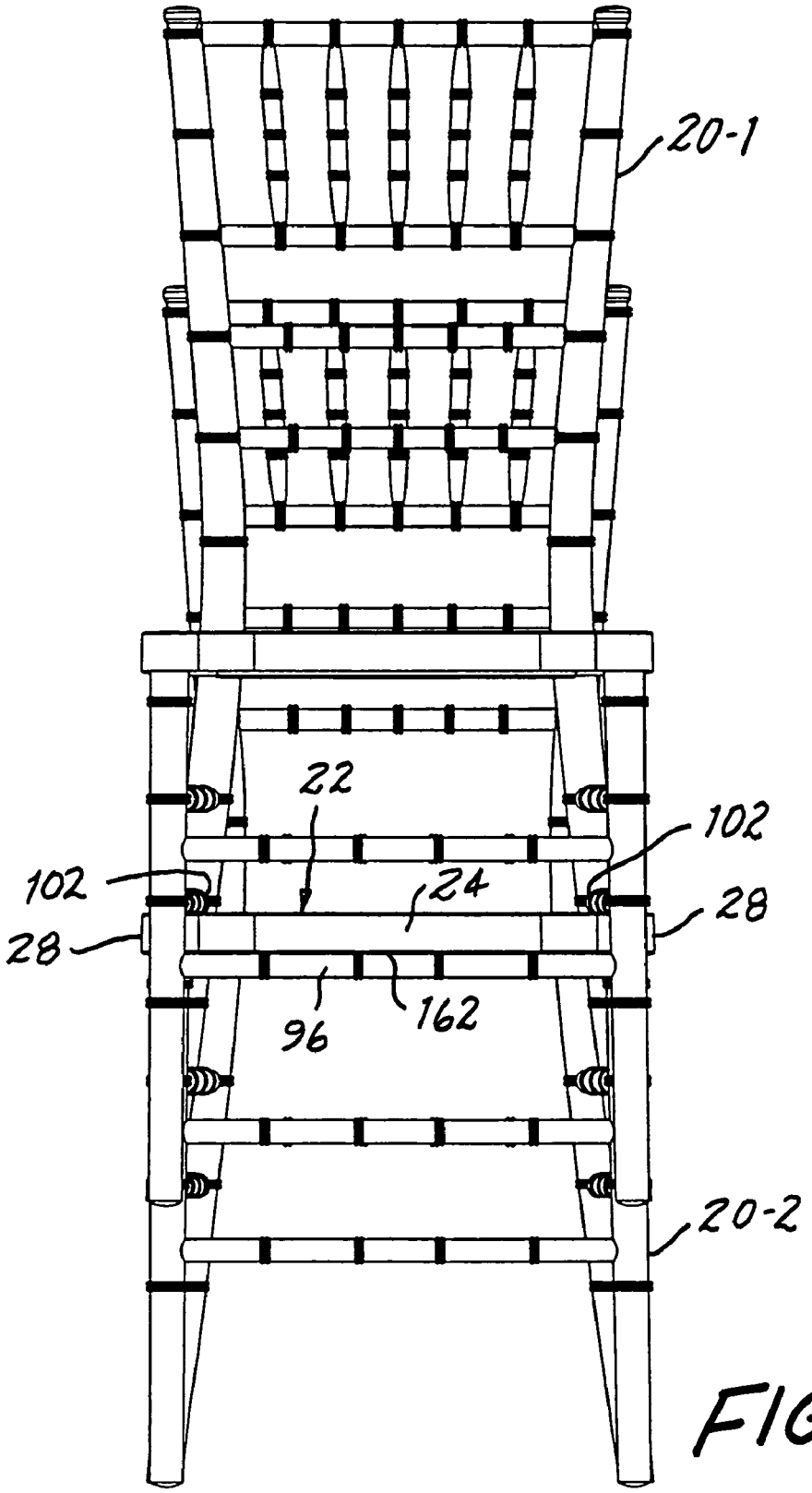
FIG. 9 is a front elevational view of the stacked event chairs of FIG. 8.
Figure 10:
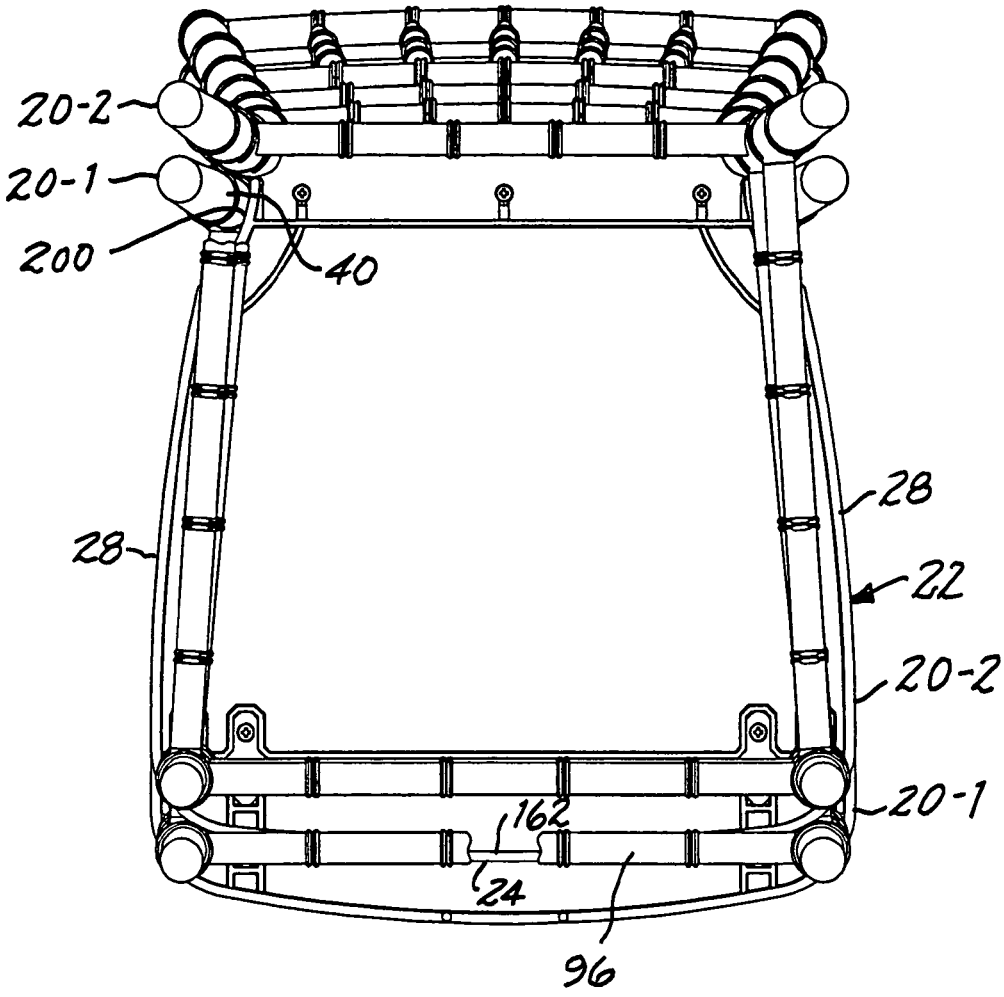
FIG. 10 is a bottom plan view of the stacked event chairs.

Turning now to FIGS. 7 through 10, assembled chairs 20 are stacked readily to form a stable vertical stack of like chairs for ease of storage and transport to the site of an event. The structural configuration of chair 20 enables a plurality of like chairs 20 to be stacked efficiently in a stable vertical stack; however, for illustrative purposes, only two contiguous stacked chairs 20, shown as an upper chair 20-1 and a lower chair 20-2, appear in FIGS. 7 through 10. Thus, each chair 20 is provided with a stacking construction which includes a camming surface 200 located along each side edge 28 of the seat member 22, adjacent an intersection 210 between the side edge 28 and the back edge 26 of the seat member 22 (also see FIG. 2). The camming surface 200 is configured, dimensioned and located relative to the rear legs 40 and the lower front brace 96 such that upon juxtaposition of an upper chair 20-1 with a lower chair 20-2, as shown in FIG. 7, and movement of the upper chair 20-1 downward into engagement with lower chair 20-2 to establish stacking of chairs 20-1 and 20-2, as shown in FIGS. 8, 9 and 10, the camming surfaces 200 of the lower chair 20-2 will engage corresponding rear legs 40 of the upper chair 20-1 to move the upper chair 20-1 in a rearward direction 212 relative to the lower chair 20-2 as the upper chair 20-1 is lowered over the lower chair 20-2. Simultaneously, the lower front brace 96 of the upper chair 20-1 will be moved downwardly and rearwardly to be placed beneath and into engagement with the underside 162 of seat member 22 of the lower chair 20-2, adjacent the front edge 24 of the seat member 22 of the lower chair 20-2, thereby stabilizing the stacked upper and lower chairs 20-1 and 20-2 by virtue of the engagement between the corresponding lower front brace 96 and the seat member 22, adjacent the front edge 24 of the seat member 22.

In addition, the lower side members 102 of each chair 20 are located relative to the seat member 22 such that upon movement of the lower front brace 96 of the upper chair 20-1 into engagement with the seat member 22, adjacent the front edge 24 of the seat member 22 of the lower chair 20-2, the lower side members 102 of the upper chair 20-1 will rest upon the seat member 22 of the lower chair 20-2, adjacent the side edges 28 of the seat member 22, as seen in FIGS. 8 and 9, thereby further stabilizing the stacked upper and lower chairs 20-1 and 20-2, by virtue of the engagement between lower side members 102 of upper chair 20-1 and seat member 22 of lower chair 20-2. That stability is enhanced further by the provision of downwardly-facing flattened portions at the decorative rings 104 of the lower side members 102, illustrated in the form of flats 220 (also see FIGS. 5 and 6) which establish a more stable purchase upon the counterpart seat member 22. In this manner, an effective stable stack of a plurality of chairs 20 is established with ease and efficiency.

It will be seen that the present invention attains the several objects and advantages summarized above, namely; Provides an event chair and method of constructing an event chair enabling ready manufacture utilizing a combination of synthetic polymeric materials and reinforcing metal components to simulate closely the aesthetic appearance and seating comfort of previous event chairs constructed of wood or metal, while attaining requisite strength, rigidity and durability; provides event chairs and a method of construction which incorporate synthetic polymeric materials to enable conservation of synthetic polymeric material, with a concomitant reduction in cost, while attaining enhanced strength, rigidity, comfort and safety, as well as a desired aesthetic appearance and feel; enables effective and efficient stacking of event chairs in stable and uniform stacks for convenient storage, and for ready transport to and from the site of an event; provides event chairs of increased structural strength and rigidity as well as durability, while more closely simulating the aesthetic appearance of traditional wooden and metal event chairs; facilitates the manufacture and compact packaging for storage and for shipping of event chairs to end users, with increased ease of erection by such end users; enables economical manufacture of event chairs requiring less maintenance and providing exemplary performance over an increased service life.

It is to be understood that the above detailed description of preferred embodiments of the invention is provided by way of example only. Various details of design, procedure and construction may be modified without departing from the true spirit and scope of the invention, as set forth in the appended claims.

The invention claimed is:

1. A chair having component parts capable of compact packaging for transportation and storage, and ready assembly to erect the chair for use, the chair comprising:

a seat member extending longitudinally between a front edge and a longitudinally opposite back edge, and having laterally opposite side edges;

a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides;

a front member having a front seat support extending laterally between opposite front seat support ends, a pair of front legs depending from the front seat support, with one front leg extending altitudinally downwardly from adjacent each front seat support end to a corresponding front foot end;

at least one side member for extending longitudinally between each front leg and a corresponding rear leg, and for being coupled with the corresponding front and rear legs;

the back member being constructed of a synthetic polymeric material molded over a metal core such that the rear seat support, the rear legs and the chair back comprise a rigid component part including an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back;

the front member being constructed of a synthetic polymeric material molded over a metal core such that the front legs each comprise a further rigid component part including an integral structure of synthetic polymeric material having an integral reinforcing metal core extending altitudinally through each front leg from adjacent a corresponding front foot end of each front leg to adjacent a corresponding front seat support end;

each side member being constructed of a synthetic polymeric material molded over a metal core such that each side member comprises a still further rigid component part including an integral structure of synthetic polymeric material having an integral reinforcing metal core extending longitudinally through each side member; and a coupling arrangement at each end of each side member, at the front member, and at the back member for coupling the metal core of each side member with the metal core of the front member and the metal core of the back member, such that upon erection of the chair each side member will extend longitudinally between corresponding front and rear legs and engage a front leg intermediate the front seat support and a corresponding front foot end, and engage a rear leg intermediate the rear seat support and a corresponding rear foot end, with the metal cores of the front member, the back member and the side members secured together in a rigid integral metal core structure to establish a rigid chair construction comprised of the rigid component parts coupled together at the rigid couplings.

2. The chair of claim 1 wherein the metal cores comprise tubular metal members.

3. The chair of claim 2 wherein the tubular metal members are constructed of steel.

4. The chair of claim 1 wherein the back member, the front member and the side members each comprise a unitary sheath of synthetic polymeric material molded so as essentially to envelop a corresponding reinforcing metal core.

5. The chair of claim 4 wherein each metal core comprises a tubular metal member.

6. The chair of claim 5 wherein the tubular metal members are constructed of steel.

7. The chair of claim 1 wherein the front member includes at least one front brace extending laterally between the front legs, intermediate each front seat support end and a corresponding front foot end, and the reinforcing metal core of the front member extends through the front brace from one to the other of the front legs.

8. The chair of claim 1 wherein the back member includes a back brace extending laterally between the rear legs, intermediate each rear seat support end and a corresponding rear foot end, and the reinforcing metal core of the back member extends through the back brace from one to the other of the rear legs.

9. The chair of claim 1 wherein each coupling arrangement comprises complementary screw-threaded fastener elements for securing the metal core of each side member with the metal core of the front member and the metal core of the back member.

10. The chair of claim 1 wherein the front seat support of the front member includes a lateral support element extending between the front seat support ends and a transverse support element integral with the lateral support element adjacent each front seat support end, the transverse support elements being oriented in a generally longitudinal direction and having a longitudinal length for engaging corresponding portions of the seat member adjacent the front edge of the seat member to facilitate stabilizing of the seat member upon erection of the chair.

11. The chair of claim 10 wherein each transverse support element comprises a support bar, and each corresponding portion of the seat member comprises a socket complementary to a counterpart support bar for capturing the counterpart support bar upon erection of the chair.

12. The chair of claim 1 wherein the rear seat support comprises a beam member extending between the rear seat support ends, the beam member establishing a beam configuration for engagement with the seat member adjacent the back edge of the seat member to facilitate support of the seat member upon erection of the chair.

13. The chair of claim 1 wherein, upon erection of the chair, the chair is stacked readily with further chairs in a stable vertical stack of contiguous upper and lower chairs, the chair including a stacking construction comprising:

a front brace extending laterally between the front legs, intermediate each front seat support end and a corresponding front foot end; and a camming surface along each side edge of the seat member, adjacent an intersection of a corresponding side edge with the back edge of the seat member;

the camming surfaces being configured, dimensioned and located relative to the rear legs and the front brace such that upon juxtaposition of an upper chair over a lower chair to establish the vertical stack of chairs, the camming surfaces of the lower chair will engage the rear legs of the upper chair to move the upper chair in a rearward direction relative to the lower chair as the upper chair is lowered over the lower chair, and simultaneously to move the front brace of the upper chair rearwardly to be placed beneath and into engagement with the seat member of the lower chair, adjacent the front edge of the seat member of the lower chair, thereby stabilizing the stacked upper and lower chairs by virtue of the engagement between the camming surfaces of the lower chair and corresponding rear legs of the upper chair, and the engagement between the front brace of the upper chair and the seat member of the lower chair, adjacent the front edge of the seat member of the lower chair.

14. The chair of claim 13 wherein the side members of the chair are located relative to the seat member such that upon movement of the front brace of the upper chair beneath and into engagement with the seat member of the lower chair, adjacent the front edge of the seat member of the lower chair, the side members of the upper chair will rest upon the seat member of the lower chair, adjacent the side edges of the seat member of the lower chair, thereby further stabilizing the stacked upper and lower chairs by virtue of the engagement between the side members of the upper chair and the seat member of the lower chair.

15. An improvement in a chair having component parts capable of ready assembly to erect the chair for use, the chair including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the improvement comprising:

the front seat support of the front member including a lateral support element extending between the front seat support ends and a transverse support element integral with the lateral support element adjacent each front seat support end, the transverse support elements being oriented in a generally longitudinal direction and having a longitudinal length for engaging corresponding portions of the seat member adjacent the front edge of the seat member to facilitate stabilizing of the seat member upon erection of the chair.

16. The chair of claim 15 wherein each transverse support element comprises a support bar, and each corresponding portion of the seat member comprises a socket complementary to a counterpart support bar for capturing the counterpart support bar upon erection of the chair.

17. An improvement in a chair having component parts capable of ready assembly to erect the chair for use, the chair including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the improvement comprising:

the rear seat support including a beam member extending between the rear seat support ends, the beam member having laterally extending, altitudinally spaced apart flanges interconnected with a laterally extending web and laterally spaced apart ribs extending altitudinally between the flanges, establishing a hollowed, rigid beam configuration for engagement with the seat member adjacent the back edge of the seat member to facilitate support of the seat member upon erection of the chair.

18. A chair constructed for stacking readily with further chairs in a stable vertical stack of contiguous upper and lower chairs, each chair of the stack including a seat member extending longitudinally between a front edge and a longitudinally opposite back edge, and having laterally opposite side edges, a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides, and a front member having a front seat support extending laterally between opposite front seat support ends, a pair of front legs depending from the front seat support, with one front leg extending altitudinally downwardly from adjacent each front seat support end to a corresponding front foot end, the chair including a stacking construction comprising:

a front brace extending laterally between the front legs, intermediate each front seat support end and a corresponding front foot end; and a camming surface along each side edge of the seat member, adjacent an intersection of a corresponding side edge with the back edge of the seat member;

the camming surfaces being configured, dimensioned and located relative to the rear legs and the front brace such that upon juxtaposition of an upper chair over a lower chair to establish the vertical stack of chairs, the camming surfaces of the lower chair will engage the rear legs of the upper chair to move the upper chair in a rearward direction relative to the lower chair as the upper chair is lowered over the lower chair, and simultaneously to move the front brace of the upper chair rearwardly to be placed beneath and into engagement with the seat member of the lower chair, adjacent the front edge of the seat member of the lower chair, thereby stabilizing the stacked upper and lower chairs by virtue of the engagement between the camming surfaces of the lower chair and corresponding rear legs of the upper chair, and the engagement between the front brace of the upper chair and the seat member of the lower chair, adjacent the front edge of the seat member of the lower chair.

19. The chair of claim 18 including at least one side member extending longitudinally between each front leg and a corresponding rear leg, the side members being located relative to the seat member such that upon movement of the front brace of the upper chair beneath and into engagement with the seat member of the lower chair, adjacent the front edge of the seat member of the lower chair, the side members of the upper chair will rest upon the seat member of the lower chair, adjacent the side edges of the seat member of the lower chair, thereby further stabilizing the stacked upper and lower chairs by virtue of the engagement between side members of the upper chair and the seat member of the lower chair.

20. A chair constructed of a synthetic polymeric material reinforced with an integral reinforcing metal core structure, the chair comprising:

a seat member extending longitudinally between a front edge and a longitudinally opposite back edge, and having laterally opposite side edges;

a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides;

a front member having a front seat support extending laterally between opposite front seat support ends, a pair of front legs depending from the front seat support, with one front leg extending altitudinally downwardly from adjacent each front seat support end to a corresponding front foot end;

at least one side member extending longitudinally between each front leg and a corresponding rear leg, and being coupled with the corresponding front and rear legs;

the back member being constructed of a synthetic polymeric material molded over a metal core such that the rear seat support, the rear legs and the chair back comprise a rigid component part including an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back;

the front member being constructed of a synthetic polymeric material molded over a metal core such that the front legs each comprise a rigid further component part including an integral structure of synthetic polymeric material having an integral reinforcing metal core extending altitudinally through each front leg from adjacent a corresponding front foot end of each front leg to adjacent a corresponding front seat support end;

each side member being constructed of a synthetic polymeric material molded over a metal core such that each side member comprises a rigid still further component part including an integral structure of synthetic polymeric material having an integral reinforcing metal core extending longitudinally through each side member; and corresponding ends of each side member being joined respectively with the front member and with the back member, with the metal core of each side member joined with the metal core of the front member and with the metal core of the back member, such that each side member extends longitudinally between corresponding front and rear legs and engages a front leg intermediate the front seat support and a corresponding front foot end, and engages a rear leg intermediate the rear seat support and a corresponding rear foot end and the metal cores of the front member, the back member and the side members are joined in a rigid integral reinforcing metal core structure to establish a rigid chair construction comprised of the joined together rigid component parts.

21. The chair of claim 20 wherein the metal cores comprise tubular metal members.

22. The chair of claim 21 wherein the tubular metal members are constructed of steel.

23. The chair of claim 20 wherein the back member, the front member and the side members each comprise a unitary sheath of synthetic polymeric material molded so as essentially to envelop a corresponding reinforcing metal core.

24. The chair of claim 23 wherein each metal core comprises a tubular metal member.

25. The chair of claim 24 wherein the tubular metal members are constructed of steel.

26. The chair of claim 20 wherein the front member includes at least one front brace extending laterally between the front legs, intermediate each front seat support end and a corresponding front foot end, and the reinforcing metal core of the front member extends through the front brace from one to the other of the front legs.

27. The chair of claim 20 wherein the back member includes a back brace extending laterally between the rear legs, intermediate each rear seat support end and a corresponding rear foot end, and the reinforcing metal core of the back member extends through the back brace from one to the other of the rear legs.

28. A method for constructing a chair having component parts capable of compact packaging for transportation and storage, and ready assembly to erect the chair for use, the method comprising:

constructing a seat member extending longitudinally between a front edge and a longitudinally opposite back edge, and having laterally opposite side edges;

constructing a back member having a rear seat support extending laterally between opposite rear seat support ends, a pair of rear legs depending from the rear seat support, with one rear leg extending altitudinally downwardly from adjacent each rear seat support end to a corresponding rear foot end, and a chair back extending altitudinally upwardly from the rear seat support to a head end, the chair back extending laterally between laterally opposite sides;

constructing a front member having a front seat support extending laterally between opposite front seat support ends, a pair of front legs depending from the front seat support, with one front leg extending altitudinally downwardly from adjacent each front seat support end to a corresponding front foot end;

constructing at least one side member for extending longitudinally between each front leg and a corresponding rear leg, and for being coupled with the corresponding front and rear legs;

constructing the back member by molding a synthetic polymeric material over a metal core such that the rear seat support, the rear legs and the chair back comprise a rigid component part including an integral structure of synthetic polymeric material having an integral reinforcing metal core extending altitudinally through each rear leg from adjacent a corresponding rear foot end of each rear leg toward the head end of the chair back, and laterally through the chair back, adjacent the head end of the chair back;

constructing the front member by molding a synthetic polymeric material over a metal core such that the front legs each comprise a rigid further component part including an integral structure of synthetic polymeric material having an integral reinforcing metal core extending altitudinally through each front leg from adjacent a corresponding front foot end of each front leg to adjacent a corresponding front seat support end;

constructing each side member by molding a synthetic polymeric material over a metal core such that each side member comprises a still further rigid component part including an integral structure of synthetic polymeric material having an integral reinforcing metal core extending longitudinally through each side member; and coupling the metal core of each side member with the metal core of the front member and the metal core of the back member at respective rigid couplings, such that each side member extends longitudinally between corresponding front and rear legs and engages a front leg intermediate the front seat support and a corresponding front foot end, and engages a rear leg intermediate the rear seat support and a corresponding rear foot end, with the metal cores of the front member, the back member and the side members secured together in a rigid integral metal core structure to establish a rigid chair construction comprised of the rigid component parts coupled together at the rigid couplings.

29. The method of claim 28 including constructing the metal cores of tubular metal members.

30. The method of claim 29 including constructing the tubular metal members of steel.

31. The method of claim 28 including molding the synthetic polymeric material into a unitary sheath of synthetic polymeric material over each one of a corresponding reinforcing metal core of the back member, the front member and the side members prior to securing together the metal cores to establish the integral metal core structure.

32. The method of claim 31 including constructing each metal core of a tubular metal member.

33. The method of claim 32 including constructing the tubular metal members of steel.

* * * * *